US005812167A

United States Patent [19]

Braun

[11] Patent Number: 5,812,167

[45] Date of Patent: Sep. 22, 1998

[54] CYLINDRICAL CATCHER ASSEMBLY

[75] Inventor: Hilarion Braun, Beavercreek, Ohio

[73] Assignee: Scitex Digital Printing, Inc., Dayton, Ohio

[21] Appl. No.: 605,368

[22] Filed: Feb. 22, 1996

[51] Int. Cl.[6] ..... B41J 2/185

[52] U.S. Cl. ..... 347/90

[58] Field of Search ..... 347/90, 76, 77

[56] References Cited

U.S. PATENT DOCUMENTS

| | | | |
|---|---|---|---|
| 3,611,422 | 10/1971 | Rourke | 347/90 |
| 3,813,675 | 5/1974 | Steffy et al. | 347/90 |
| 3,836,914 | 9/1974 | Duffield | 347/90 |
| 4,250,510 | 2/1981 | Dressler | 347/90 |
| 4,268,836 | 5/1981 | Huliba et al. | 347/90 |
| 4,757,328 | 7/1988 | Braun et al. | 347/90 |
| 5,469,202 | 11/1995 | Stephens | 347/90 |

OTHER PUBLICATIONS

Bloom, R.D. et al, "Ink Jet Gutter Arrangement" IBM Tech. Discl. Bull., vol. 16, No. 7, Dec. 1973, p. 2275.

*Primary Examiner*—P. W. Echols
*Attorney, Agent, or Firm*—Barbara Joan Haushalter

[57] ABSTRACT

A method of fabricating a catcher assembly for an ink jet printer replaces the standard catcher assembly with an assembly comprising at least one capillary, typically a glass capillary. Initially, a charge plate is provided. Then the capillary or capillaries are provided, the capillaries having an axis parallel to the charge plate. The external surface of each capillary comprises a catcher face, and establishes a well defined radius and surface finish.

5 Claims, 1 Drawing Sheet

CYLINDRICAL CATCHER ASSEMBLY

TECHNICAL FIELD

The present invention relates to continuous ink jet printers and, more particularly, to improved construction for the catcher assembly in such printers.

BACKGROUND ART

In continuous ink jet printing, electrically conductive ink is supplied under pressure to a manifold region that distributes the ink to a plurality of orifices, typically arranged in a linear array(s). The ink discharges from the orifices in filaments which break into droplet streams. Individual droplet streams are selectively charged in the region of the break off from the filaments and charge drops are deflected from their normal trajectories. The deflected drops may be caught and recirculated, and the undeflected drops allowed to proceed to a print medium.

Drops are charged by a charge plate having a plurality of charging electrodes along one edge, and a corresponding plurality of connecting leads along one surface. The edge of the charge plate having the charging electrodes is placed in close proximity to the break off point of the ink jet filaments, and charges applied to the leads to induce charges in the drops as they break off from the filaments.

Traditionally, the catcher has been machined out of stainless steel such that an inclined plane merged with a "radius" at the bottom of the catcher where the ink flowed around this bend into the catcher throat. In order to grind or machine a catcher over a length of 8–9" and to blend a flat area with a radius, much machine and/or grinding time is spent at a high expense. Thermal and mechanical stability of stainless steel is not as high as that of ceramics and glasses. When a ceramic or glass charge electrode structure is placed mechanically (by bonding or other means) in contact with a stainless steel catcher, a "bimetallic" strip is formed which will flex out of flatness with changes of temperature. Substitution of ceramic for the catcher is one obvious solution to the mechanical/thermal problem; however, it does not solve other problems such as the difficulty of machining, the surface smoothness, nor the expensive cost.

It is seen then that there exists a need for an improved catcher fabrication which overcomes the problems associated with the prior art.

SUMMARY OF THE INVENTION

This need is met by the catcher assembly according to the present invention, wherein the use of glass capillaries is proposed as a means for establishing a catcher surface with a well defined radius and surface finish. The capillary may be coated with a metal such as Tantalum (Ta) to protect the glass from ink jet printer ink and to provide a well defined, constant equipotential.

In accordance with one aspect of the present invention, a method of fabricating a catcher assembly for an ink jet printer replaces the standard catcher assembly with an assembly comprising at least one glass capillary. Initially, a charge plate is provided. Then at least one glass capillary is provided, the glass capillary having an axis parallel to the charge plate. The external surface of the glass capillary comprises a catcher face, and establishes a well defined radius and surface finish.

Accordingly, it is an object of the present invention to provide a catcher assembly which uses glass capillaries. This provides the advantage of establishing a catcher surface with a well defined radius and surface finish.

Other objects and advantages of the invention will be apparent from the following description, the accompanying drawings and the appended claims.

DETAILED DESCRIPTION OF THE PREFERRED EMBODIMENTS

Figure 1:
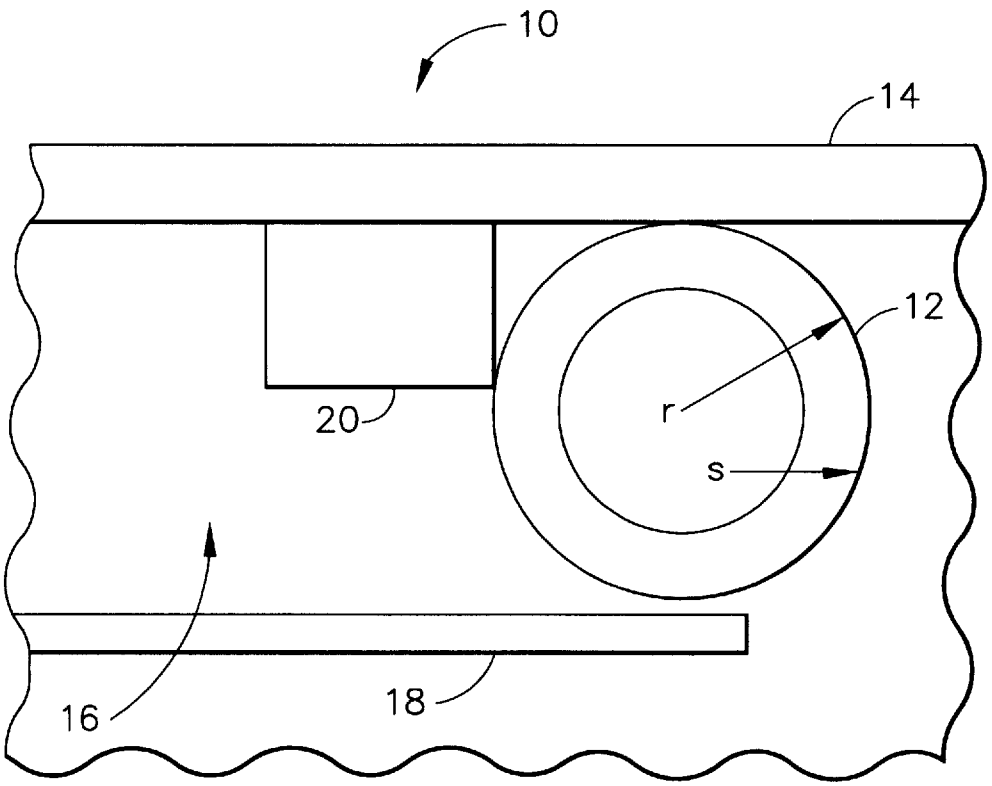
FIG. 1 is a cross sectional view of the catcher assembly, constructed in accordance with the present invention.

Referring to the drawing, in FIG. 1 there is illustrated a cross sectional view of the catcher assembly 10, constructed in accordance with the present invention. Ink jet print heads generally include a resonator assembly having an ink manifold and orifice plate for generating filaments of ink. The resonator stimulates the filaments to break off in droplets in the region of a charging electrode on a charge plate and catcher assembly. Drops of ink are selectively charged by the charging electrodes and deflected onto a catcher face and into a catcher throat. Uncharged drops proceed undeflected to a print medium. Collected ink is withdrawn through a catcher tube and is recirculated in the ink jet printer.

The invention proposes the use of glass capillaries 12 as a means for establishing a catcher surface with a well defined radius, r, and surface finish on the outer surface of the capillary, which outer surface comprises the catcher face. Glass capillary 12 is mounted, as illustrated in FIG. 1, by applying a holding element, such as epoxy, onto backing block 20 and on the bottom of charge plate 14. The capillary 12 may be coated with a metal such as Ta to protect the glass from ink jet printer ink and to provide a well defined, constant equipotential.

In a preferred embodiment of the present invention, the capillary, or tube, 12 and a charge plate 14 are bonded together in a fixture, i.e., held in correct juxtaposition during epoxy curing. Catcher throat 16 and catch pan 18 are assembled in a separate assembly step.

As is well known, capillaries can be made with very well defined radii. In a given capillary, the radius is uniform over lengths of several feet, while r may be as small as 0.06" or less. Consequently, the tubes 12 of the present invention provide attractive catcher surfaces, since the surface finish is specular and hence will offer only a small drag on the fluid flow. Since radius, r, can be held within close tolerances, a setback, s, can be easily held by fixturing, such that a backing block 20 can be bonded to the charge plate bottom surface. The backing block 20 provides a mounting surface for the capillary. Capillary 12 can then be bonded parallel to backing block 20, where the uniform radius, r, of the capillary determines the uniformity of the setback, s, via the bonding fixture.

Industrial Applicability and Advantages

The present invention is useful in the field of ink jet printing, and has the advantage of providing an improved catcher assembly. The catcher assembly uses glass capillaries, providing the advantage of establishing a catcher surface with a well defined radius and surface finish, at negligible cost. Currently, the machining of such a surface and radius is prohibitively expensive. In contrast, capillary tubes, as according to the present invention, are readily available and inexpensive.

Having described the invention in detail and by reference to the preferred embodiment thereof, it will be apparent that other modifications and variations are possible without departing from the scope of the invention defined in the appended claims.

I claim:

1. A catcher assembly for an ink jet printer comprising:

a. a charge plate;

b. at least one tubular glass element having an axis parallel to the plane of the charge plate, wherein an external surface of the tubular glass element functions as a catcher face.

2. A catcher assembly for an ink jet printer as claimed in claim 1, wherein the at least one tubular glass element is coated with a metal.

3. A catcher assembly for an ink jet printer as claimed in claim 2, wherein the metal comprises Tantalum.

4. A catcher assembly for an ink jet printer as claimed in claim 1, wherein the at least one tubular glass element is located below the charge plate.

5. A catcher assembly for an ink jet printer as claimed in claim 1 further comprising a backing block for providing a mounting surface for the at least one tubular glass element.

* * * * *